US011250764B2

(12) United States Patent
Sun et al.

(10) Patent No.: US 11,250,764 B2
(45) Date of Patent: Feb. 15, 2022

(54) MURA COMPENSATION DEVICE, DISPLAY DEVICE AND MURA COMPENSATION METHOD

(71) Applicants: Hefei BOE Display Technology Co., Ltd., Hefei (CN); BOE TECHNOLOGY GROUP CO., LTD., Beijing (CN)

(72) Inventors: Jianwei Sun, Beijing (CN); Liugang Zhou, Beijing (CN); Yizhan Han, Beijing (CN); Tao Li, Beijing (CN); Yulong Xiong, Beijing (CN)

(73) Assignees: Hefei BOE Display Technology Co., Ltd., Hefei (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/957,748

(22) PCT Filed: Dec. 11, 2019

(86) PCT No.: PCT/CN2019/124638
§ 371 (c)(1),
(2) Date: Jun. 25, 2020

(87) PCT Pub. No.: WO2020/140708
PCT Pub. Date: Jul. 9, 2020

(65) Prior Publication Data

US 2021/0225239 A1 Jul. 22, 2021

(30) Foreign Application Priority Data

Jan. 2, 2019 (CN) ..... 201910001824.3

(51) Int. Cl.
*G09G 3/20* (2006.01)

(52) U.S. Cl.
CPC ... *G09G 3/2096* (2013.01); *G09G 2320/0233* (2013.01); *G09G 2360/145* (2013.01)

(58) Field of Classification Search
CPC ..... G09G 3/2096; G09G 2320/0233; G09G 2360/145
See application file for complete search history.

(56) References Cited

U.S. PATENT DOCUMENTS 7,012,667 B2 3/2006 Pai
7,623,216 B2 * 11/2009 Hwang ..... G09G 3/006 349/192
(Continued)

FOREIGN PATENT DOCUMENTS

CN 104699334 A 6/2015
CN 106125367 A 11/2016
(Continued)

OTHER PUBLICATIONS

International Search Report and Written Opinion for International Application No. PCT/CN2019/124638 dated Mar. 13, 2020.
(Continued)

*Primary Examiner* — Gene W Lee
(74) *Attorney, Agent, or Firm* — Thomas | Horstemeyer, LLP

(57) ABSTRACT

The present disclosure provides a mura compensation device, display panel, display device, and mura compensation method, which belongs to the field of panel technology. The mura compensation device includes a first flexible circuit board and a de-mura circuit, including a storage unit for storing mura compensation data, wherein the de-mura circuit is provided in the first flexible circuit board.

12 Claims, 5 Drawing Sheets

(56) References Cited

U.S. PATENT DOCUMENTS

| | | | | |
|---|---|---|---|---|
| 8,149,230 | B2 | 4/2012 | Lee et al. | |
| 8,179,390 | B2 | 5/2012 | Lee et al. | |
| 2004/0027526 | A1 | 2/2004 | Pai | |
| 2004/0027527 | A1 | 2/2004 | Pai | |
| 2006/0017669 | A1* | 1/2006 | Cok | G09G 3/3216 345/77 |
| 2006/0022969 | A1 | 2/2006 | Lee et al. | |
| 2008/0266282 | A1 | 10/2008 | Lee et al. | |
| 2015/0138474 | A1* | 5/2015 | Chang | G02F 1/133 349/43 |
| 2020/0111430 | A1* | 4/2020 | Saito | G09G 3/3275 |

FOREIGN PATENT DOCUMENTS

| | | | |
|---|---|---|---|
| CN | 106952626 | A | 7/2017 |
| CN | 107170415 | A | 9/2017 |
| CN | 108399862 | A | 8/2018 |
| CN | 108470542 | A | 8/2018 |
| CN | 108510965 | A | 9/2018 |
| CN | 106125367 | B | 3/2019 |
| CN | 109616507 | A | 4/2019 |
| CN | 106952626 | B | 5/2019 |
| CN | 107170415 | B | 9/2019 |

OTHER PUBLICATIONS

First Office Action for CN Patent Application No. 201910001824.3 dated Mar. 31, 2020.

* cited by examiner

MURA COMPENSATION DEVICE, DISPLAY DEVICE AND MURA COMPENSATION METHOD

CROSS-REFERENCE TO RELATED APPLICATIONS

The present application is a national phase application under 35 U.S.C. § 371 of International Patent Application No. PCT/CN2019/124638, filed on Dec. 11, 2019, which claims the benefit of and priority to Chinese Patent Application No. 201910001824.3, titled "MURA COMPENSATION DEVICE, DISPLAY PANEL, DISPLAY DEVICE AND MURA COMPENSATION METHOD" filed on Jan. 2, 2019, the contents of which are incorporated by reference in their entireties herein.

TECHNICAL FIELD

The present disclosure relates to the field of display technology and, in particular, to a mura compensation device, display panel, display device, and mura compensation method.

BACKGROUND

With the rapid development of display panel technology, the demand for large-size high-resolution display panels is increasing. As the demand for large-size high-quality display panels surges in the market, various LCD panel manufacturers have established high-generation lines, and shipments of large-size panels of 65 or larger inches have greatly increased. However, due to the panel manufacturing process, the large-size panels are more prone to mura defects than small- and medium-size panels, which affects product yield. Therefore, de-mura technology is required to improve image display quality.

Therefore, there is a need for a new mura compensation device, display panel, display device, and mura compensation method.

It should be noted that the information disclosed in the above background section is only for enhancing the understanding of the background of the present disclosure, and therefore may include information that does not constitute the prior art known to those skilled in the art.

SUMMARY

A first aspect of the present disclosure provides a mura compensation device, including: a first flexible circuit board; and a de-mura circuit, including a storage unit for storing mura compensation data, wherein the de-mura circuit is provided in the first flexible circuit board.

A second aspect of the present disclosure provides a display panel, including the mura compensation device described in the above embodiment.

In an exemplary embodiment of the present disclosure, the display panel further includes a plurality of printed circuit boards bonded to a same side of the display panel, wherein at least two of the printed circuit boards are coupled through the first flexible circuit board.

In an exemplary embodiment of the present disclosure, a number of the plurality of printed circuit boards is greater than or equal to 3, a part of the plurality of printed circuit boards is coupled through the first flexible circuit board, and another part of the plurality of printed circuit boards is coupled through a second flexible circuit board, and the de-mura circuit is not provided in the second flexible circuit board.

In an exemplary embodiment of the present disclosure, the display panel further includes a control printed circuit board, a timing controller is provided in the control printed circuit board, and the timing controller is coupled to the storage unit, and configured to read the mura compensation data stored in the storage unit to compensate display data of the display panel according to the mura compensation data.

A third aspect of the present disclosure provides a display device including the display panel described in the above embodiments.

A fourth aspect of the present disclosure provides a mura compensation method applied to a display panel, which includes a plurality of printed circuit boards bonded to a same side of the display panel. The mura compensation method includes: obtaining a light-on image of the display panel; determining whether the display panel has mura according to the light-on image; and coupling at least two of the plurality of printed circuit boards through a first flexible circuit board according to that the display panel has the mura, wherein a de-mura circuit is provided in the first flexible circuit board.

In an exemplary embodiment of the present disclosure, the mura compensation method further includes coupling the plurality of printed circuit boards through a second flexible circuit board according to that the display panel does not have the mura, wherein the de-mura circuit is not provided in the second flexible circuit board.

In an exemplary embodiment of the present disclosure, the mura compensation method further includes: obtaining mura compensation data based on the light-on image according to that the display panel has the mura; and storing the mura compensation data in a storage unit of the de-mura circuit.

In an exemplary embodiment of the present disclosure, the mura compensation method further includes: reading the mura compensation data in the storage unit; compensating received display data according to the mura compensation data; and displaying compensated display data.

It should be understood that the above general description and the following detailed description are only exemplary and explanatory, and do not limit the present disclosure.

BRIEF DESCRIPTION OF THE DRAWINGS

The drawings herein are incorporated into the specification, constitute a part of the specification, illustrate embodiments consistent with the present disclosure, and together with the specification, server to explain the principle of the present disclosure. Understandably, the drawings in the following description are only some embodiments of the present disclosure. Those skilled in the art may obtain other drawings based on these drawings without paying any creative labor.

DETAILED DESCRIPTION

Figure 1:
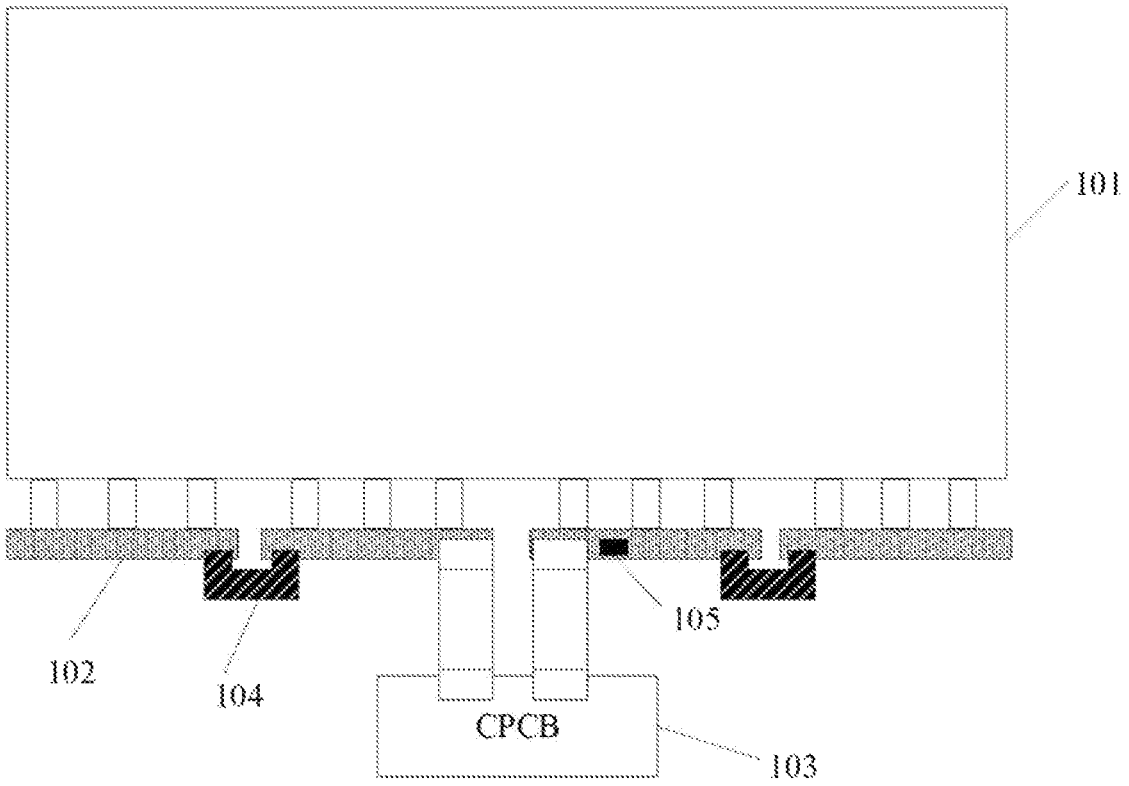
FIG. 1 shows a schematic structural diagram of a mura compensation means in the related art.

Example embodiments will now be described more fully with reference to the drawings. However, the example embodiments can be implemented in various forms, and should not be construed as being limited to the examples set forth herein; on the contrary, these embodiments are provided so that the present disclosure is more comprehensive and complete, and fully convey the concept of the example embodiments to those skilled in the art. The described features, structures, or characteristics may be combined in one or more embodiments in any suitable manner.

Further, the drawings are only schematic illustrations of the present disclosure and are not necessarily drawn to scale. The same reference numerals in the drawings denote the same or similar parts, and thus their repeated description will be omitted. Some of the blocks shown in the drawings are functional entities and do not necessarily have to correspond to physically or logically independent entities. These functional entities may be implemented in the form of software, or implemented in one or more hardware circuits or integrated circuits, or implemented in different networks and/or processor devices and/or microcontroller devices.

FIG. 1 shows a schematic structural diagram of a mura compensation means in the related art.

As shown in FIG. 1, the mura compensation means in the related art includes a display screen 101, X printed circuit board (XPCB, a printed circuit board in an X-direction of the display screen) 102, control printed circuit board (CPCB) 103, flexible printed circuit board (FPC) 104, and de-mura circuit 105.

In the related art, the de-mura circuit 105 is integrated on the XPCB 102 of the display panel. Since mura defect of the display panel needs to be confirmed by a light-on detection, and the XPCB 102 has been coupled to the display screen 101 before the light-on detection, the XPCB 102 cannot be replaced after the fabrication of the display panel is completed. The disadvantage of such design is that once a de-mura function is needed, the de-mura circuits 105 can only be attached on the XPCBs 102 in batches. In this way, it is a waste of cost to install the de-mura circuit 105 on the XPCB of the display panel that is found to have no mura defect after the light-on defection.

On the other hand, in a case where the de-mura circuits 105 are not attached on the XPCBs 102 in batches, when a display panel is found to have mura defect by the light-on detection, the de-mura circuit 105 is welded manually to the display panel with the mura defect, which is time-consuming and laborious, and has a large functional risk. Therefore, such method is not suitable for mass production.

It should be noted that a PCB in an embodiment of the present disclosure may refer to a printed circuit board assembly (PCBA), which refers to a process of placing an element on an empty PCB through a surface mount technology (SMT), and then a dual inline-pin package (DIP) technology is performed thereon.

Figure 2:
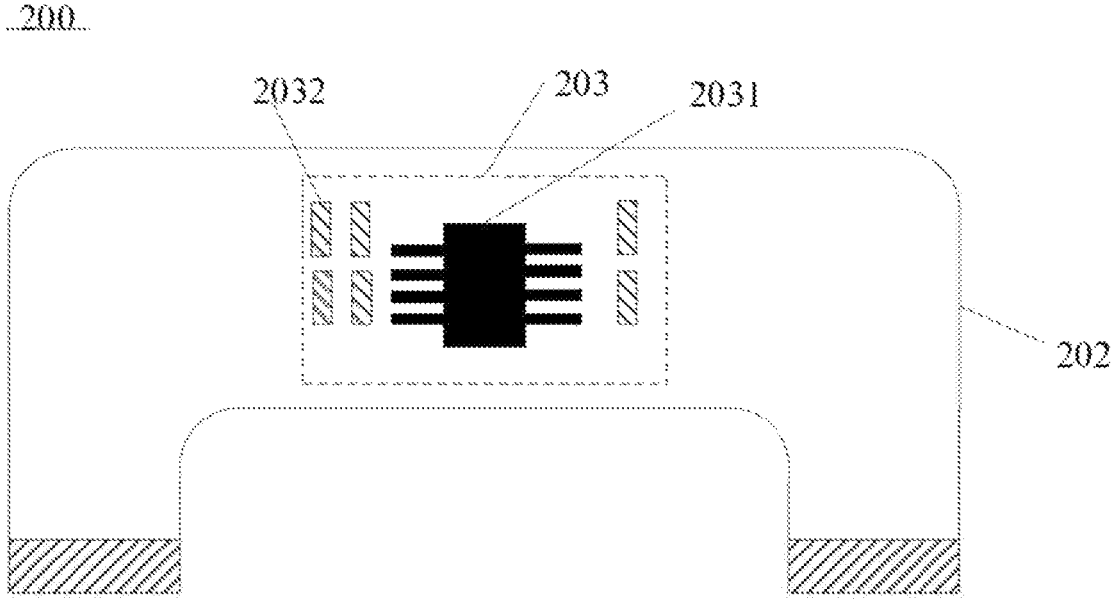
FIG. 2 schematically shows a schematic structural diagram of a mura compensation device in an exemplary embodiment of the present disclosure.

FIG. 2 schematically shows a schematic structural diagram of a mura compensation device in an exemplary embodiment of the present disclosure.

As shown in FIG. 2, the mura compensation device 200 provided by an embodiment of the present disclosure may include a first flexible circuit board (first FPC) 202 and a de-mura circuit 203. The de-mura circuit 203 is provided in the first flexible circuit board 202.

Referring to FIG. 2 again, the de-mura circuit 203 may include a storage unit 2031 and a peripheral circuit 2032, and the storage unit 2031 may be used to store mura compensation data.

Specifically, the storage unit 2031 may be a flash integrated circuit (IC, which may also be called a NOR flash), an electrically erasable programmable read only memory (EEPROM) and the like, and the present disclosure is not limited thereto.

In the mura compensation device provided by the embodiment of the present disclosure, the de-mura circuit is provided in the first FPC to form a special FPC, and thus the special FPC can be applied to couple XPCBAs of the display panel having mura defect, which can overcome the problems in the related art that the cost is wasted in the attaching the de-mura circuits in batches and that the manually welding the de-mura circuit is not suitable for mass production. That is, the mura compensation device provided by the embodiment of the present disclosure can reduce the production cost and has mass production.

Figure 3:
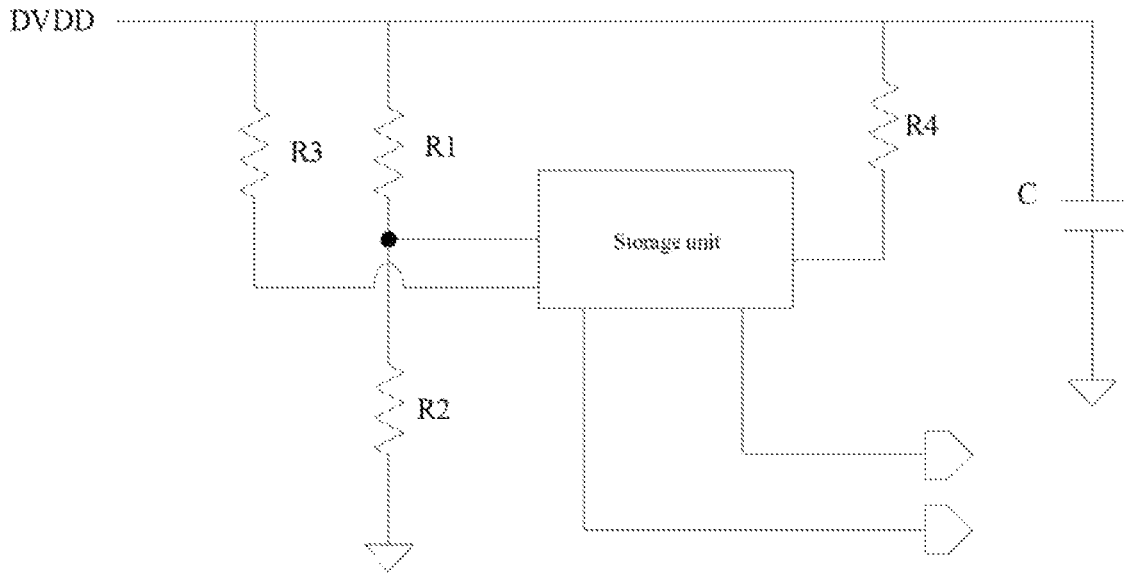
FIG. 3 schematically shows a circuit structure diagram of a de-mura circuit in an exemplary embodiment of the present disclosure.

FIG. 3 schematically shows a circuit structure diagram of a de-mura circuit in an exemplary embodiment of the present disclosure.

As shown in FIG. 3, the de-mura circuit provided by an embodiment of the present disclosure may include a storage unit and a peripheral circuit.

The peripheral circuit may include a power supply terminal coupled to a power supply voltage DVDD, resistors R1, R2, R3 and R4, and a capacitor C. A first terminal of the resistor R1 is coupled to the power supply terminal, and a second terminal of the resistor R1 is coupled to a first port of the storage unit. A first terminal of the resistor R2 is coupled to the second terminal of the resistor R1, and a second terminal of the resistor R2 is grounded. A first terminal of the resistor R3 is coupled to the power supply terminal, and a second terminal of the resistor R3 is coupled to a second port of the storage unit. A first terminal of the resistor R4 is coupled to the power supply terminal, and a second terminal of the resistor R4 is coupled to a third port of the storage unit. A first terminal of the capacitor C is coupled to the power supply terminal, and a second terminal of the capacitor C is grounded. The storage unit may further include a fourth port and a fifth port respectively configured to write the mura compensation data into the storage unit and read the mura compensation data from the storage unit.

Figure 4:
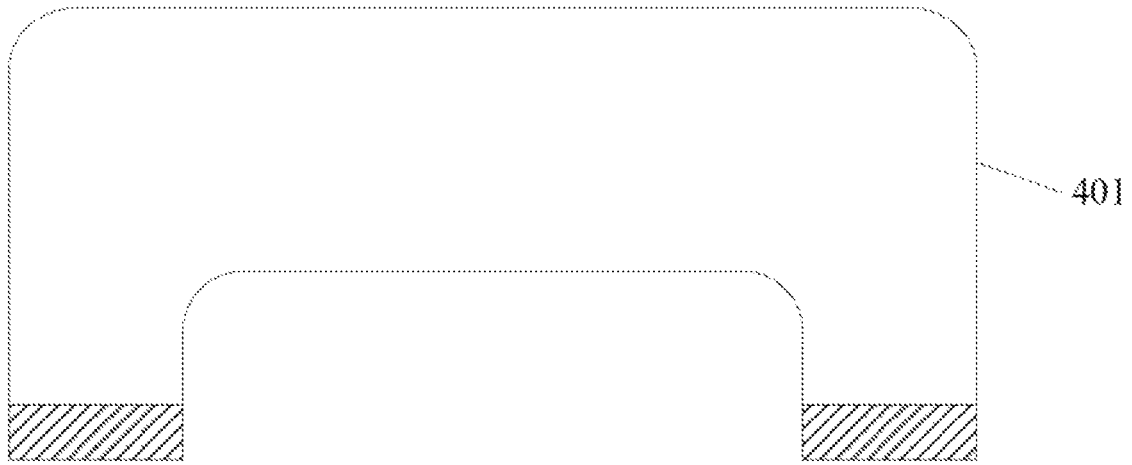
FIG. 4 schematically shows a schematic diagram of a second flexible circuit board in an exemplary embodiment of the present disclosure.

FIG. 4 schematically shows a schematic diagram of a second flexible circuit board in an exemplary embodiment of the present disclosure.

FIG. 4 shows a second flexible circuit board (second FPC, also referred to as ordinary FPC) 401 provided in an embodiment of the present disclosure. As shown in FIG. 4, the second FPC 401 is not provided with a de-mura circuit.

On one hand, the second FPC 401 provided by the embodiment of the present disclosure can be applied to couple two adjacent XPCBs of the display panel that does not require de-mura processing and has a good picture quality, and on the other hand, can also be applied to couple other two adjacent XPCBs, than the XPCBs coupled by the first FPC, of the display panel that has mura defect.

Further, an embodiment of the present disclosure further provides a display panel including the mura compensation device provided by the above embodiment.

In an exemplary embodiment, the display panel has mura. The display panel may further include a plurality of printed circuit boards bonded to a same side of the display panel. In other embodiments, the plurality of printed circuit boards may be disposed on different sides of the display panel, which is not limited in the present disclosure.

In an exemplary embodiment, a size of the display panel is greater than a preset size, for example, 65 inches, that is, the display panel is a large-size panel.

In an embodiment of the present disclosure, the large-size display panel may include a plurality of XPCBs (printed circuit boards in an X-direction of the display screen). It should be noted that the X-direction here refers to a transverse or horizontal direction of the display panel. The plurality of XPCBs are sequentially arranged along the horizontal direction of the display panel, and thus called XPCBs, but the present disclosure is not limited to thereto.

In an embodiment of the present disclosure, at least two printed circuit boards of the plurality of printed circuit boards are coupled through the first flexible circuit board.

In an embodiment of the present disclosure, a number of the plurality of printed circuit boards may be greater than or equal to 3. A part of the plurality of printed circuit boards is coupled through the first flexible circuit board, another part of the plurality of printed circuit boards is coupled through a second flexible circuit board, and the de-mura circuit is not provided in the second flexible circuit board.

The display panel provided by an embodiment of the present disclosure will be exemplified below with reference to the embodiment of FIG. 5, but the present disclosure is not limited thereto.

Figure 5:
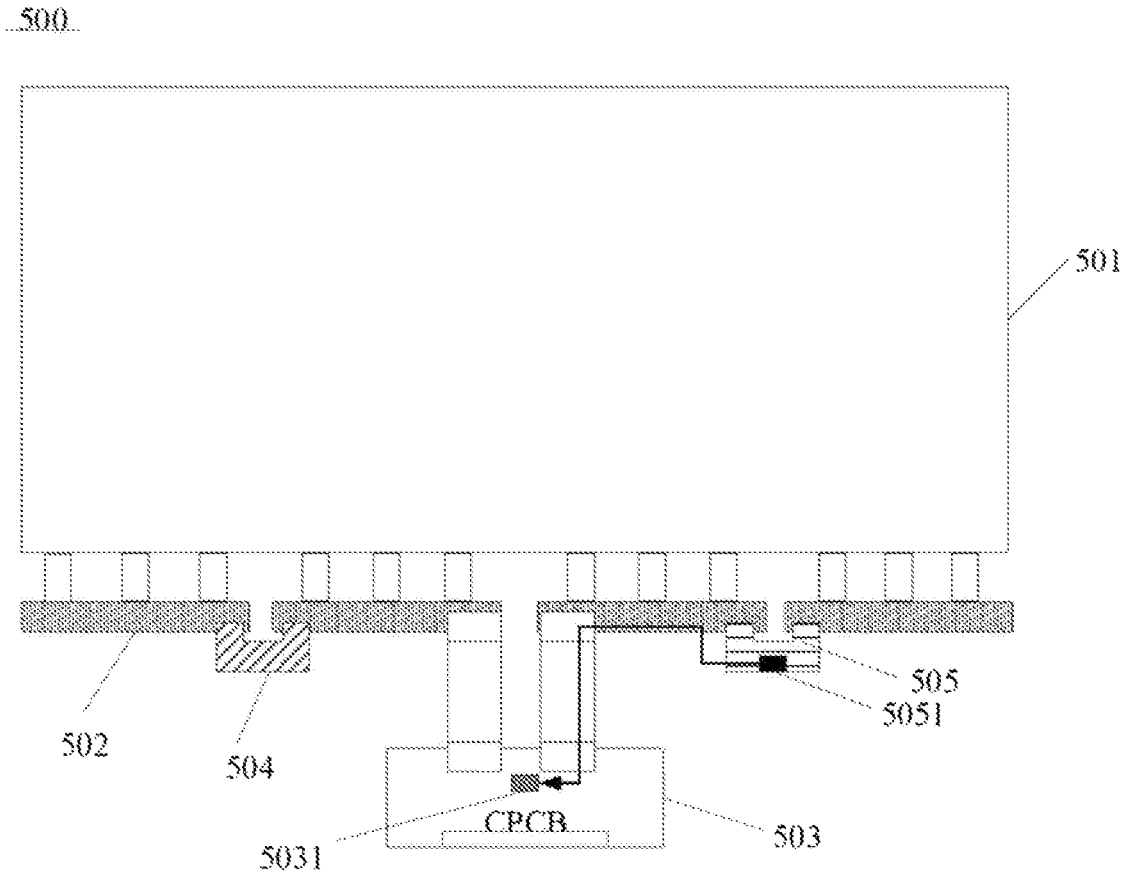
FIG. 5 schematically shows a schematic structural diagram of a display panel in an exemplary embodiment of the present disclosure.

FIG. 5 schematically shows a schematic structural diagram of a display panel in an exemplary embodiment of the present disclosure.

As shown in FIG. 5, the display panel 500 provided by an embodiment of the present disclosure may include a display screen 501, XPCBs 502, a CPCB 503, a second FPC 504, and a first FPC 505. A de-mura circuit 5051 is provided in the first FPC 505.

In an embodiment of the present disclosure, the display screen 501 may be an OLED display screen, an AMOLED display screen, or an LCD display screen, which is not limited in the present disclosure.

With reference to FIG. 5 again, a timing controller (TCON IC) 5031 may be provided in the CPCB 503. The timing controller 5031 is coupled to the de-mura circuit 5051.

In the embodiment shown in FIG. 5, it is assumed that the display panel 500 includes four XPCBs 502, and the four XPCBs 502 are sequentially arranged along the horizontal direction of the display panel. Two XPCBs 502 are located on one side (for example, the left side), and the other two XPCBs 502 are located on the other side (for example, the right side).

With reference to FIG. 5 again, it is assumed here that the two adjacent XPCBs 502 on the left side is coupled by the second FPC 504, that is, an ordinary FPC with no de-mura circuit; and the two adjacent XPCBs 502 on the right side is coupled by the first FPC 505, that is, a special FPC with the de-mura circuit.

In the embodiment of FIG. 5, the arrow shows signal transmission between the TCON IC 5031 on the CPCB 503 and the storage unit such as flash IC on the first FPC 505. The flash IC is a storage unit for storing mura compensation data, for example, the mura compensation data is written into the storage unit through the fourth port described above with reference to FIG. 3. Each time after the display panel is turned on, the TCON IC 5031 first transmits signal through a serial peripheral interface (SPI) and reads the mura compensation data through the fifth port of the storage unit described above with reference to FIG. 3, compensates data such as display data transmitted from a front end, finally outputs the same to the display screen 501 for display.

It should be noted that although in the above example, four XPCBs arranged on the same side of the display panel are taken as an example for description, in other embodiments, the technical solution provided by the embodiment of the present disclosure may be applied to any type of PCB on the display panel, and the number, position and the like of the PCB are not limited herein.

In the display panel provided by the embodiment of the present disclosure, after confirming that a display panel has mura defect through a light-on detection, at least one of the ordinary FPCs for coupling the XPCBs in the display panel may be replaced with the special FPC, so that the mura compensation data can be stored into the storage unit of the special FPC to compensate the display panel with mura defect, and thus the function of eliminating mura defect may be achieved. That is, in the technical solution provided by the embodiment of the present disclosure, the de-mura circuit is integrated in the FPC which is replaceable, therefore, the ordinary PFC or the special FPC can be flexibly used to couple the XPCBAs according to the light-on detection result of the display panel, which on one hand, can reduce the production cost of the display panel that does not have mura defect, and on the other hand, can achieve the mass production of the display panels with mura defect.

Further, an embodiment of the present disclosure further provides a display device including the display panel according to any one of the foregoing embodiments.

The display device may be any electronic device with a display panel, such as a television, an electronic paper book, a smart phone, a tablet computer, a navigator, and the like.

Figure 6:
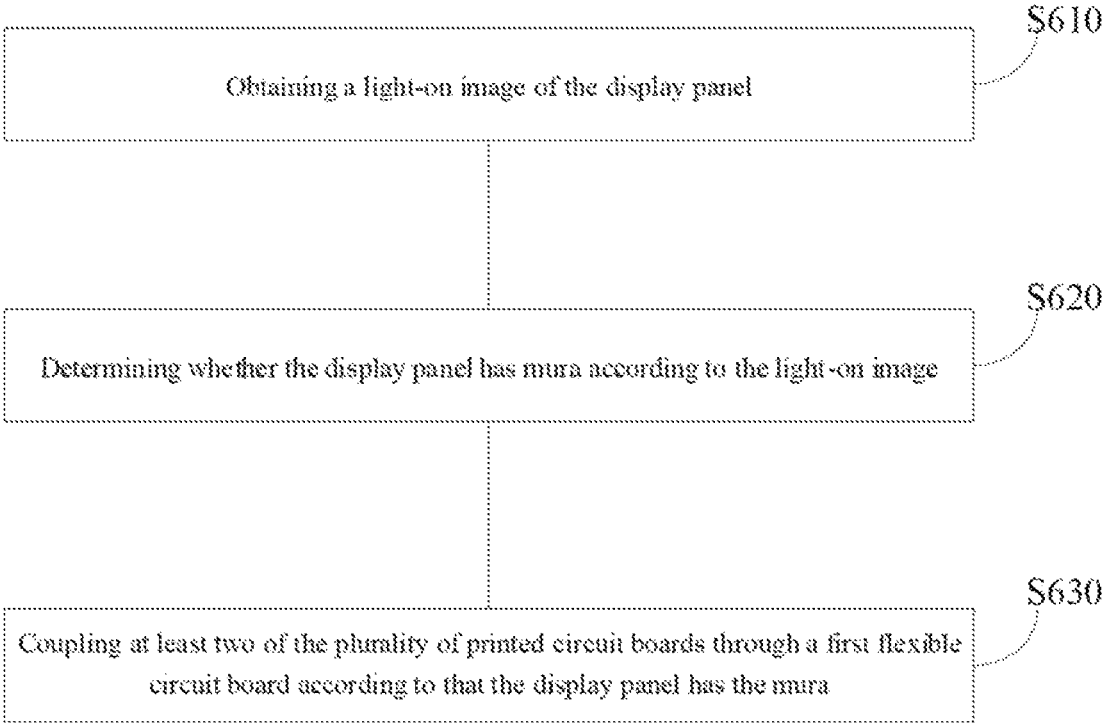
FIG. 6 schematically shows a flowchart of a mura compensation method in an exemplary embodiment of the present disclosure.

FIG. 6 schematically shows a flowchart of a mura compensation method in an exemplary embodiment of the present disclosure. The mura compensation method provided by an embodiment of the present disclosure may be applied to a display panel, and the display panel may include a plurality of printed circuit boards bonded to a same side of the display panel.

As shown in FIG. 6, the mura compensation method provided by an embodiment of the present disclosure may include:

step S610, obtaining a light-on image of the display panel;

step S620, determining whether the display panel has mura according to the light-on image; and step S630, coupling at least two of the plurality of printed circuit boards through a first flexible circuit board according to that the display panel has the mura.

A de-mura circuit is provided in the first flexible circuit board.

In an exemplary embodiment, the mura compensation method may further include coupling the plurality of printed circuit boards through a second flexible circuit board according to that the display panel does not have the mura, wherein the de-mura circuit is not provided in the second flexible circuit board.

In an exemplary embodiment, the mura compensation method may further include: obtaining mura compensation data based on the light-on image according to that the display panel has the mura; and storing the mura compensation data in a storage unit of the de-mura circuit.

In an exemplary embodiment, the mura compensation method may further include: reading the mura compensation data in the storage unit; compensating received display data according to the mura compensation data; and displaying compensated display data.

For other contents in the embodiments of the present disclosure, please refer to the other embodiments described above.

Figure 7:
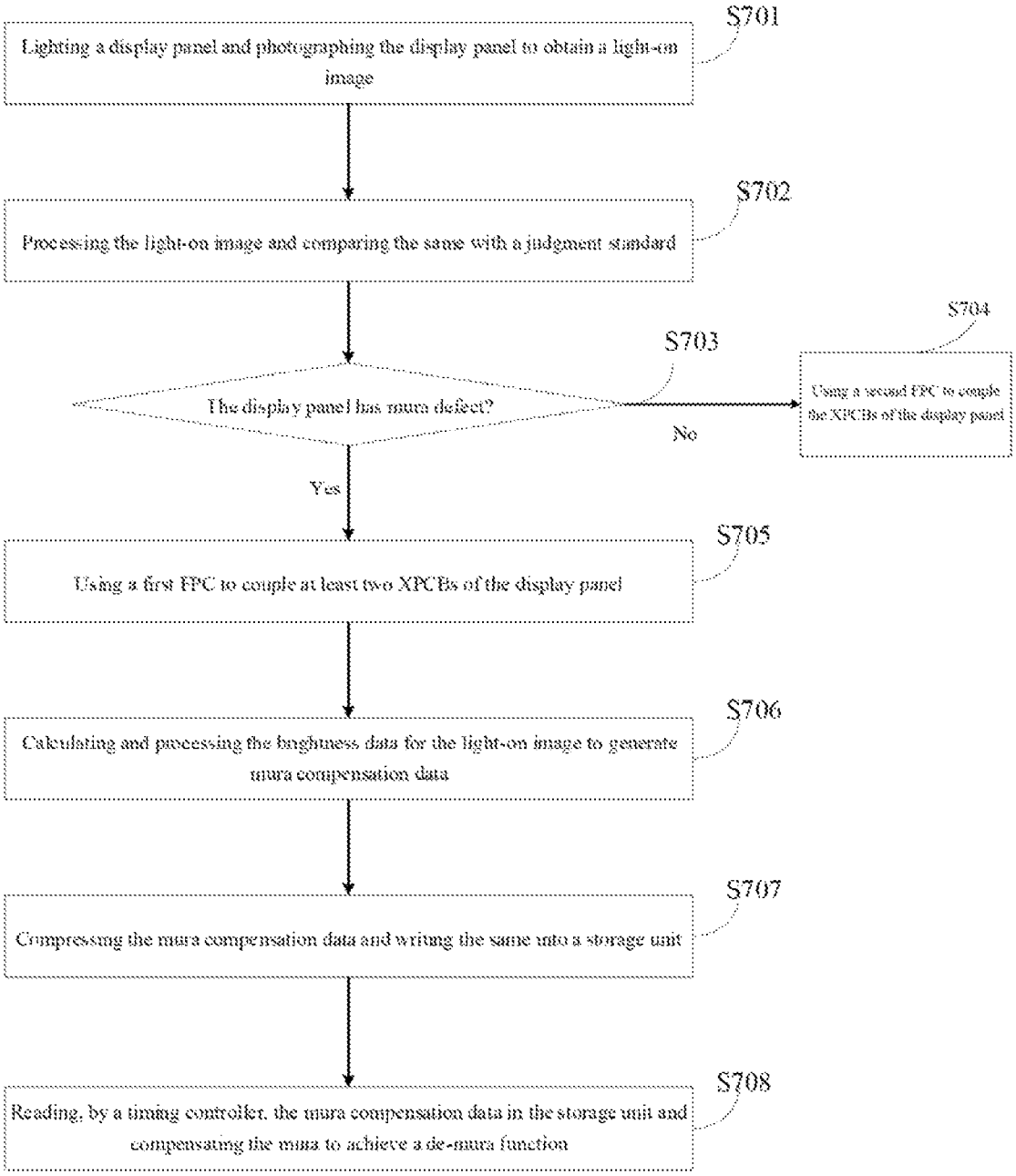
FIG. 7 schematically shows a flowchart of another mura compensation method in an exemplary embodiment of the present disclosure.

FIG. 7 schematically shows a flowchart of another mura compensation method in an exemplary embodiment of the present disclosure.

As shown in FIG. 7, the mura compensation method provided by an embodiment of the present disclosure may include the following steps.

In step S701, a display panel is lighted and photographed to obtain a light-on image.

In an embodiment of the present disclosure, the display panel is externally compensated by an optical extraction method. The optical extraction method refers to a method of lighting the display panel and then extracting brightness signal of the display panel by photographing the same using a photo-optical charge-coupled device (CCD). The optical extraction method has the advantages of simple structure and flexible method, which is the so called de-mura here. The word mura is derived from Japan and originally meant uneven brightness and darkness, and then expanded to any color difference on the panel that can be recognized by human eyes.

In an embodiment of the present disclosure, an automatic optical inspection (AOI) apparatus is used to detect mura, and after detecting mura, the mura is compensated and eliminated, that is, de-mura.

First, a driving chip in the display panel lights the panel to display several pictures (generally grayscale or RGB). Then, a high-resolution and high-precision CCD camera is used to photograph the above pictures to obtain the light-on image.

The CCD camera with high precision and high resolution is generally used when photographing the detection picture. The camera resolution is selected based on the resolution and size of a detected panel, photographing distance and accuracy of de-mura compensation. Final data obtained by the camera is XYZ, so that subsequent calculations are based on the XYZ data obtained by the camera.

In step S702, the light-on image is processed and compared to a judgment standard.

In an embodiment of the present disclosure, after obtaining XYZ distribution data of the panel, different muras can be detected according to different algorithms with regard to corresponding mura detection standards. According to the data collected by the camera, pixel color distribution characteristics are analyzed, and the mura is identified according to a corresponding algorithm.

In step S703, it is determined whether the display panel has mura defect, if it has mura defect, it proceeds to step S705, and if it does not have mura defect, it proceeds to step S704.

In step S704, the XPCBs of the display panel are coupled through a second FPC.

In step S705, at least two XPCBs of the display panel are coupled through a first FPC.

In step S706, the brightness data is calculated and processed for the light-on image to generate mura compensation data.

The mura compensation data is generated according to the mura data and a corresponding de-mura compensation algorithm.

In step S707, the mura compensation data is compressed and written into a storage unit. For example, the compressed mura compensation data is written into the storage unit through the fourth port thereof described above with reference to FIG. 3.

After the mura compensation data is determined, the mura compensation data shall be burned into the storage unit to achieve compensation effect. The size of the mura compensation data occupying the storage unit depends on the screen resolution and compensation accuracy (pixel level, 3*3, 5*5 . . . ).

In step S708, a timing controller reads the mura compensation data in the storage unit and compensates the mura to achieve a de-mura function. For example, referring to FIG. 5, during reading the mura compensation data, the mura compensation data is transmitted from the fifth port of the storage unit, through corresponding wires on the first FPC 505 and the XPCB 502 coupled to the first FPC 505, and finally to the timing controller 5031.

Through the description of the above embodiments, those skilled in the art can easily understand that the example embodiments described here can be implemented by software, or can be implemented by software in combination with necessary hardware. Therefore, the technical solution according to the embodiments of the present disclosure may be embodied in the form of a software product, which may be stored in a non-volatile storage medium (which may be a CD-ROM, U disk, mobile hard disk and the like) or on a network, and may include several instructions to cause a computing device (which may be a personal computer, server, terminal device, network device or the like) to perform the method according to the embodiments of the present disclosure.

In an exemplary embodiment of the present disclosure, there is also provided a computer-readable storage medium on which a program product capable of implementing the above method of this specification is stored. In some possible implementations, various aspects of the present invention may also be implemented in the form of a program product, which includes program codes, and when the program product runs on a terminal device, the program codes are used to cause the terminal device to execute the steps according to various exemplary embodiments of the present disclosure described in the "exemplary method" section of this specification.

In addition, the above-mentioned drawings are only schematic illustrations of processes included in the method according to the exemplary embodiment of the present disclosure, and are not for limiting. It is easy to understand that the processes shown in the above drawings do not indicate or limit the chronological order of these processes. In addition, it is also easy to understand that these processes may be performed synchronously or asynchronously in multiple circuits, for example.

Those skilled in the art will easily think of other embodiments of the present disclosure after considering the description and practicing the invention disclosed herein. This application is intended to cover any variations, uses, or adaptive changes of the present disclosure that follow the general principle of the present disclosure and include common knowledge or customary technical means in the art not disclosed in the present disclosure. The description and examples are to be considered exemplary only, and the true scope and spirit of the present disclosure are pointed out by the appended claims.

What is claimed is:

1. A mura compensation device, comprising:

a first flexible circuit board; and a de-mura circuit, comprising a storage unit for storing mura compensation data, wherein:

the de-mura circuit is provided in the first flexible circuit board;

the mura compensation device further comprises a peripheral circuit, the peripheral circuit comprising a power supply terminal, a first resistor, a second resistor, a third resistor, a fourth resistor and a capacitor;

a first terminal of the first resistor is coupled to the power supply terminal, and a second terminal of the first resistor is coupled to a first port of the storage unit;

a first terminal of the second resistor is coupled to the second terminal of the first resistor, and a second terminal of the second resistor is grounded;

a first terminal of the third resistor is coupled to the power supply terminal, and a second terminal of the third resistor is coupled to a second port of the storage unit;

a first terminal of the fourth resistor is coupled to the power supply terminal, and a second terminal of the fourth resistor is coupled to a third port of the storage unit; and a first terminal of the capacitor is coupled to the power supply terminal, and a second terminal of the capacitor is grounded.

2. The mura compensation device according to claim 1, wherein the storage unit further comprises a fourth port and a fifth port respectively configured to write the mura compensation data into the storage unit and read the mura compensation data from the storage unit.

3. A display device, comprising:

a mura compensation device and a display panel, wherein the mura compensation device comprises:

a first flexible circuit board; and a de-mura circuit comprising a storage unit for storing mura compensation data, wherein the de-mura circuit is provided in the first flexible circuit board, wherein:

the mura compensation device further comprises a peripheral circuit;

the peripheral circuit comprises a power supply terminal, a first resistor, a second resistor, a third resistor, a fourth resistor and a capacitor;

a first terminal of the first resistor is coupled to the power supply terminal, and a second terminal of the first resistor is coupled to a first port of the storage unit;

a first terminal of the second resistor is coupled to the second terminal of the first resistor, and a second terminal of the second resistor is grounded;

a first terminal of the third resistor is coupled to the power supply terminal, and a second terminal of the third resistor is coupled to a second port of the storage unit;

a first terminal of the fourth resistor is coupled to the power supply terminal, and a second terminal of the fourth resistor is coupled to a third port of the storage unit; and a first terminal of the capacitor is coupled to the power supply terminal, and a second terminal of the capacitor is grounded.

4. The display device according to claim 3, further comprising:

a plurality of printed circuit boards, bonded to a same side of the display panel, wherein at least two of the printed circuit boards are coupled through the first flexible circuit board.

5. The display device according to claim 4, wherein a number of the plurality of printed circuit boards is greater than or equal to 3, a part of the plurality of printed circuit boards is coupled through the first flexible circuit board, and another part of the plurality of printed circuit boards is coupled through a second flexible circuit board, and the de-mura circuit is not provided in the second flexible circuit board.

6. The display device according to claim 3, further comprising a control printed circuit board, wherein a timing controller is provided in the control printed circuit board, and the timing controller is coupled to the storage unit, and configured to read the mura compensation data stored in the storage unit to compensate display data of the display panel according to the mura compensation data.

7. The display device according to claim 3, wherein the storage unit further comprises a fourth port and a fifth port respectively configured to write the mura compensation data into the storage unit and read the mura compensation data from the storage unit.

8. A mura compensation method applied to a display device, comprising:

providing the display device, the display device comprising a display panel and a plurality of printed circuit boards bonded to a same side of the display panel;

obtaining a light-on image of the display panel;

determining whether the display panel has mura according to the light-on image; and coupling at least two of the plurality of printed circuit boards through a first flexible circuit board in response to the determination that the display panel has the mura, wherein a de-mura circuit is provided in the first flexible circuit board.

9. The mura compensation method according to claim 8, further comprising: coupling the plurality of printed circuit boards through the second flexible circuit board in response to the determination that the display panel does not have the mura, wherein the de-mura circuit is not provided in the second flexible circuit board.

10. The mura compensation method according to claim 8, wherein a number of the plurality of printed circuit boards is greater than or equal to 3, and the method further comprises:

coupling a part of the plurality of printed circuit boards through the first flexible circuit board; and coupling another part of the plurality of printed circuit boards through a second flexible circuit board, wherein the de-mura circuit is not provided in the second flexible circuit board.

11. The mura compensation method according to claim 10, further comprising:

obtaining mura compensation data based on the light-on image in accordance with the determination that the display panel has the mura; and storing the mura compensation data in a storage unit of the de-mura circuit.

12. The mura compensation method according to claim 11, further comprising:

reading the mura compensation data in the storage unit;

compensating received display data according to the mura compensation data; and displaying compensated display data.

* * * * *